US009384958B2

(12) United States Patent
Genz

(10) Patent No.: US 9,384,958 B2
(45) Date of Patent: Jul. 5, 2016

(54) HIGH-PRESSURE DISCHARGE LAMP

(75) Inventor: Andreas Genz, Berlin (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/124,265

(22) PCT Filed: May 9, 2012

(86) PCT No.: PCT/EP2012/058546

§ 371 (c)(1),
(2), (4) Date: Dec. 6, 2013

(87) PCT Pub. No.: WO2012/168022

PCT Pub. Date: Dec. 13, 2012

(65) Prior Publication Data

US 2014/0103799 A1 Apr. 17, 2014

(30) Foreign Application Priority Data

Jun. 9, 2011 (DE) ..... 10 2011 077 302

(51) Int. Cl.

| | |
|---|---|
| ***H01J 61/16*** | (2006.01) |
| ***H01J 61/12*** | (2006.01) |
| ***H01J 61/82*** | (2006.01) |

(52) U.S. Cl.

CPC ..... *H01J 61/16* (2013.01); *H01J 61/125* (2013.01); *H01J 61/827* (2013.01)

(58) Field of Classification Search

CPC ..... H01J 61/125; H01J 61/16; H01J 61/827
USPC ..... 313/572
See application file for complete search history.

(56) References Cited

U.S. PATENT DOCUMENTS

| | | | | |
|---|---|---|---|---|
| 7,432,658 | B2 | 10/2008 | Derhaeg | |
| 7,670,507 | B2 | 3/2010 | Konrad et al. | |
| 8,569,952 | B2 | 10/2013 | Genz | |
| 2001/0004191 | A1 | 6/2001 | Hendricx et al. | |
| 2002/0135304 | A1 * | 9/2002 | Honda | H01J 61/30 313/634 |
| 2007/0085482 | A1 * | 4/2007 | Lambrechts et al. | 313/637 |
| 2008/0111489 | A1 | 5/2008 | Johnston et al. | |
| 2008/0224615 | A1 * | 9/2008 | Higashi | H01J 61/827 313/631 |
| 2009/0026956 | A1 * | 1/2009 | Sneider | H01J 1/16 313/631 |
| 2010/0013417 | A1 * | 1/2010 | Ramaiah | H01J 61/125 315/358 |

FOREIGN PATENT DOCUMENTS

| | | | |
|---|---|---|---|
| CN | 1339171 | A | 3/2002 |
| CN | 101636815 | A | 1/2010 |
| DE | 10307067 | B3 | 8/2004 |
| EP | 0634780 | A1 | 1/1995 |
| WO | 0143163 | A1 | 6/2001 |
| WO | 2005100508 | A1 | 10/2005 |
| WO | 2008038245 | A2 | 4/2008 |
| WO | 2008060857 | A2 | 5/2008 |
| WO | 2010052142 | A1 | 5/2010 |
| WO | 2010097732 | A2 | 9/2010 |

OTHER PUBLICATIONS

Chinese Office Action based on Application No. 201280027861.8(8 pages and 5 pages of English translation) dated Jul. 8, 2015.

* cited by examiner

*Primary Examiner* — Nimeshkumar Patel
*Assistant Examiner* — Jacob R Stern

(57) ABSTRACT

A high-pressure discharge lamp may include a bulb, which surrounds a discharge volume, wherein a fill which contains mercury and a noble gas from the group consisting of neon, argon, krypton, xenon on its own or in a mixture is accommodated in the discharge volume, wherein the fill contains Gd in halide form in order to produce a color temperature of at least 7500 K.

9 Claims, 4 Drawing Sheets

HIGH-PRESSURE DISCHARGE LAMP

RELATED APPLICATIONS

This application is a national stage entry according to 35 U.S.C. §371 of PCT application No.: PCT/EP2012/058546 filed on May 9, 2012, which claims priority from German application No.: 10 2011 077 302.9 filed on Jun. 9, 2011.

TECHNICAL FIELD

Various embodiments relate to a high-pressure discharge lamp. Said lamp is in particular a metal halide lamp. Such lamps are in particular high-pressure discharge lamps with a ceramic discharge vessel or a quartz glass vessel for general lighting.

BACKGROUND

WO 2008/038245 and WO 2010/052142 disclose a high-pressure discharge lamp, in which a metal halide fill with Gd for the light color daylight is used. The high-pressure discharge lamp contains, as metal halide, Gd together with rare-earth iodides. In this case, the discharge vessel consists of ceramic, wherein the wall loading is in the range of from 20 to 40 W/cm$^2$. The fill quantities are selected to be relatively high in order to achieve a color temperature of typically from 5000 to 6500 K corresponding to the light color daylight.

A higher light color such as skywhite has has until now (see WO 2005/100508) only been achieved by fluorescent lamps.

SUMMARY

Various embodiments provide a high-pressure discharge lamp, in a simple and inexpensive manner, a high color temperature of 7500 to 10 000 K, in particular at least 8000 K. This color temperature is above the daylight options which are already established on the market. Such lamps are gaining increasing market significance in the sector of wellness and plant lighting, possibly as a supplement to ambient lighting.

Until now, such high color temperatures have been covered solely by means of fluorescent lamps.

The disclosure relates to metal halide lamps with an extremely high color temperature which have a bulb consisting of quartz glass or else ceramic. There are three aims here: 1. high color temperature; 2. high color rendering index; 3. good maintenance.

According to the disclosure, a fill is used which contains Gd as rare-earth element. There are two possible solutions for this in accordance with the disclosure.

In a first embodiment for lamps without metallic frame parts, the fill with sodium halide can be metered since in this case there is no risk of sodium loss. Typical exemplary embodiments are lamps with a wattage of 70 and 150 W. In this solution, the proportion by weight of Gd halide in the total metal halide fill is greater than 15% by weight, preferably 20 to 45%.

In a second embodiment for lamps with metallic frame parts in the outer bulb, no Na halide is used since otherwise there is the risk of Na loss. In this case, it is better to use Cs halide, and the proportion by weight of Gd halide is below 15% by weight. Preferably, it is 5 to 12% by weight.

The present disclosure opens up a new market segment. The advantage of high-pressure discharge lamps with a quartz glass discharge vessel over the previously used fluorescent lamps consists in the higher luminance which can be achieved thereby.

A high-pressure discharge lamp including a bulb, which surrounds a discharge volume, is disclosed wherein a fill which contains mercury and a noble gas from the group consisting of neon, argon, krypton, xenon on its own or in a mixture is accommodated in the discharge volume, characterized in that the fill contains Gd in halide form in order to produce a color temperature of at least 7500 K.

In a further embodiment, the high-pressure discharge lamp is configured such that Gd is introduced in the form of $GdI_3$ and/or $GdBr_3$.

In a still further embodiment, the fill contains, as further metal halides, rare-earth halides, in particular thulium or dysprosium, and/or indium and/or thallium and/or sodium and/or cesium.

In a still further embodiment, the fill contains mercury, in particular from 1 to 100 mg.

In a still further embodiment, the total metal halide fill quantity is at most 2 mg/cm$^3$, based on the volume of the discharge vessel.

In a still further embodiment, the coldfilling pressure of the noble gas, in particular argon, is selected in the range of from 30 to 300 hPa.

In a still further embodiment, the content of Hg is selected in the range of from 3 to 30 mg/cm$^3$.

In a still further embodiment, the fill contains NaI and $GdI_3$, wherein the proportion of $GdI_3$ is greater than 15% by weight, and preferably is in the range of from 20 to 45% by weight, wherein the discharge vessel is surrounded by an outer bulb without a frame.

In a still further embodiment, the fill contains $GdI_3$ and Cs halide, wherein the proportion of $GdI_3$ is at most 15% by weight, and preferably is in the range of from 5 to 12% by weight, wherein the discharge vessel is held in an outer bulb by means of a frame.

In a still further embodiment, the discharge vessel is manufactured from quartz glass and the wall loading is in the range of from 10 to 21 W/cm$^2$.

In a still further embodiment, the metering of Gd halide lies in a region which is covered by a quadrilateral with the corner points 0.1 mg/cm$^3$ to 0.6 mg/cm$^3$ at 10 W/cm$^2$ and 0.25 mg/cm$^3$ to 0.75 mg/cm$^3$ at 21 W/cm$^2$, wherein a further fill constituent is Na halide.

In a still further embodiment, the metering of Gd halide lies in a region which is covered by a quadrilateral with the corner points 0.018 mg/cm$^3$ to 0.05 mg/cm$^3$ at 10 W/cm$^2$ and 0.035 mg/cm$^3$ to 0.063 mg/cm$^3$ at 21 W/cm$^2$, wherein a further fill constituent is Cs halide.

BRIEF DESCRIPTION OF THE DRAWINGS

In the drawings, like reference characters generally refer to the same parts throughout the different views. The drawings are not necessarily to scale, emphasis instead generally being replaced upon illustrating the principles of the disclosure. In the following description, various embodiments of the disclosure are described with reference to the following drawings, in which.

DETAILED DESCRIPTION

The following detailed description refers to the accompanying drawings that show, by way of illustration, specific details and embodiments in which the disclosure may be practiced.

Figure 1:
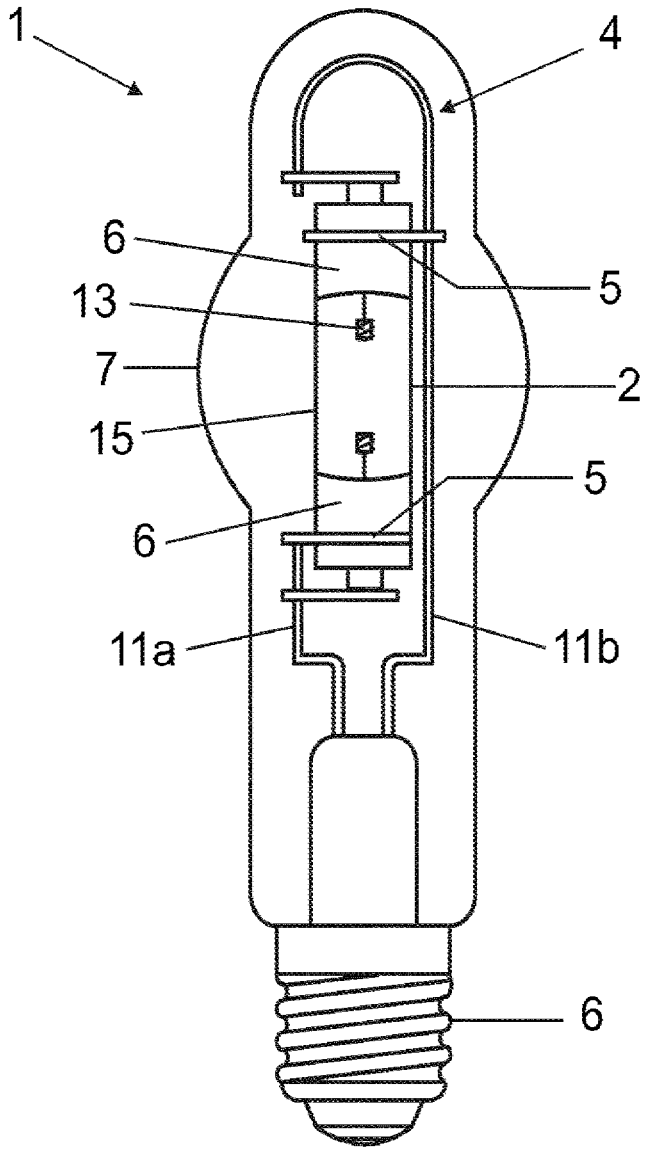
FIG. 1 shows a high-pressure discharge lamp with a discharge vessel with a separate outer bulb.

FIG. 1 shows, schematically, a metal halide lamp 1. Said lamp includes a discharge vessel 2 consisting of quartz glass, into which two electrodes 13 are introduced. The discharge vessel has a central part 15 and two ends 14. Two pinch seals 6, which are fixed by frame parts 5, rest at the ends.

The discharge vessel 2 is surrounded by an outer bulb 7. The discharge vessel 2 is held in the outer bulb by means of a frame, which contains a short and a long power supply line 11*a* and 11*b*.

The discharge vessel contains a fill, which typically includes Hg (3 to 30 mg/cm$^3$) and 0.01 to 1 mg/cm$^3$ of Gd halide. A proportion of Gd halide of from 0.02 to 0.3 mg/cm$^3$ is preferred. The total fill quantity of metal halide is at most 2 mg/cm$^3$. It is preferably in a range of from 0.10 to 1.5 mg/cm$^3$. As noble gas, argon under a pressure of from 30 to 300 hPa cold is used. As a result, a white-emitting metal halide lamp with a color temperature of 7500 to 9000 K and an Ra of at least 80 is realized.

Figure 2:
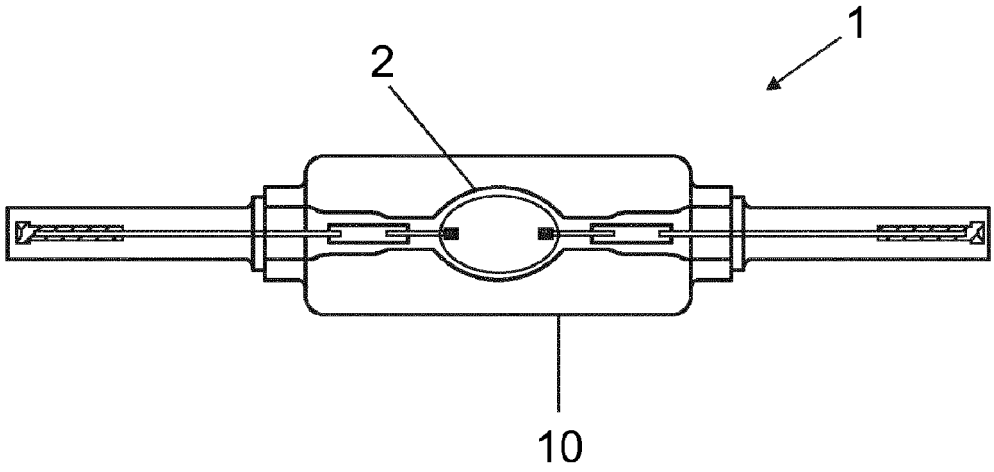
FIG. 2 shows a high-pressure discharge lamp with a discharge vessel with an integrated outer bulb.

FIG. 2 shows a second embodiment of a metal halide lamp 1 with a discharge vessel 2 consisting of quartz glass, on which an integrated outer bulb 10 is placed without a frame being required.

The discharge vessel contains a fill which typically includes Hg (3 to 30 mg/cm$^3$) and 0.01 to 1 mg/cm$^3$, preferably 0.05 to 0.9 mg/cm$^3$, of Gd halide. The total fill quantity of metal halide is at most 2 mg/cm$^3$, preferably 0.15 to 1.9 mg/cm$^3$.

Tables 1 and 2 show the lighting engineering data for a metal halide lamp with a quartz glass bulb as shown in FIG. 1.

The fill is designed for emission in the white spectral region with a color temperature of from 7500 to 10 000 K, in particular at least 8000 K. Such a lamp can be used for general lighting, in particular as supplemental lighting in plant lighting or in the wellness sector. By virtue of the novel fill, together with a discharge vessel consisting of quartz glass, a high lumen output is achieved alongside high maintenance, together with a long life and a high degree of color saturation. The life is at least 9000 hours, the maintenance is at least 80% and the color rendering index is at least 80.

Tables 3 and 4 show the lighting engineering data for a metal halide lamp with a quartz glass bulb as shown in FIG. 2.

The disclosure makes use of the property that the color temperature increases as the wall loading decreases if rare-earth halides are used in the fill. This is associated with the fact that the rare-earth metals in the fill, firstly atomically, emit short wave radiation, are predominantly blue-emitting, and, secondly as a monohalide at the edge of the arc, emit long wave radiation, are predominantly red-emitting. For this reason, the wall loading is a measure of the relative proportions of blue:red and therefore of the color temperature. The wall loading should be in the range of from 10 to 21 W/cm$^2$ in order to achieve a color temperature of 7500 K to 10 000 K, which favors the use of discharge vessels consisting of quartz glass.

Figure 3:
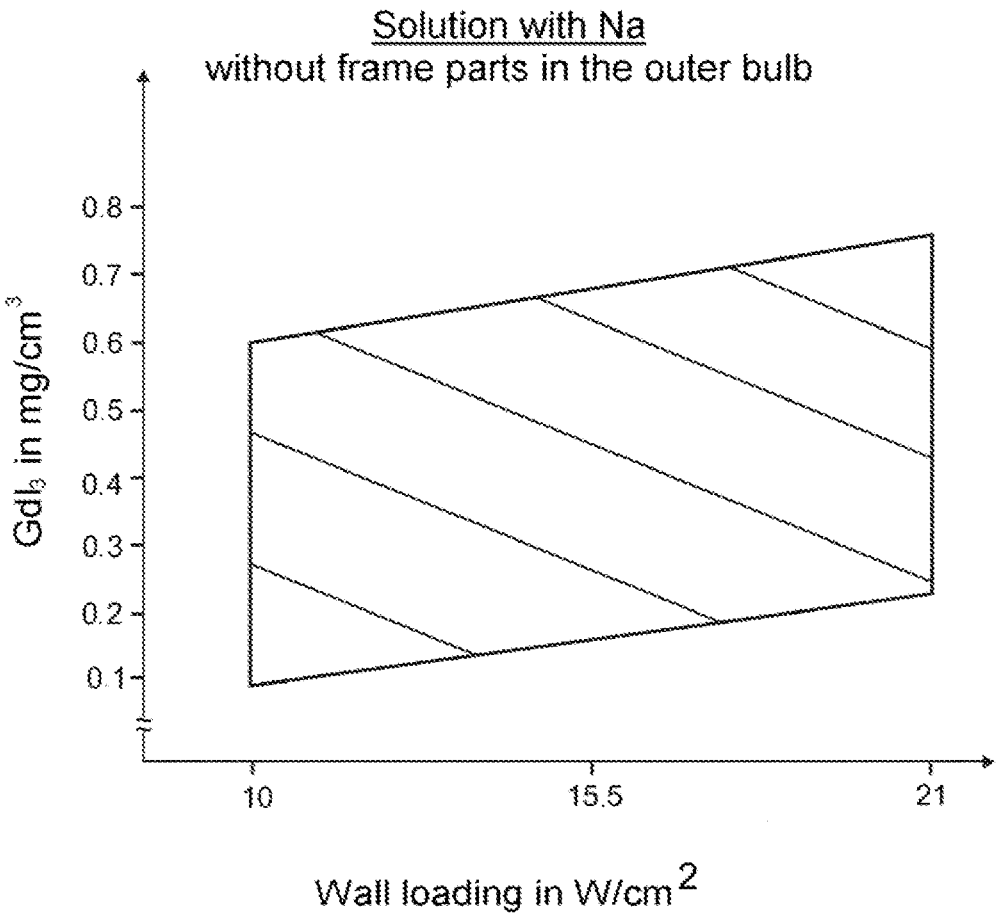
FIG. 3 shows an illustration of a favorable range for $GdI_3$ depending on the wall loading for a fill with Na.

FIG. 3 shows an advantageous range for $GdI_3$ as fill in interaction with NaI in relation to the wall loading. At a low wall loading of 10 W/cm$^2$, metering of 0.1 to 0.6 mg/cm$^3$ is advantageous. As the wall loading increases, the metering also increases up to a value of 0.25 to 0.75 mg/cm$^3$ at 21 W/cm$^2$.

In this case, the discharge vessel is held in the outer bulb without any frame parts (see FIG. 2).

A characteristic of a lamp with such a high color temperature of typically 8000 to 10 000 K is a comparatively high proportion of the emission in a blue range between 410 and 460 nm. This promotes the circadian rhythm by the response of the circadian sensor in the eye and results in melatonin suppression.

TABLE 1

| | |
|---|---|
| Power/W | 250 |
| Luminous flux/lm | 15 500 |
| Color temperature/K | 8000 |
| Average life/h | 12 000 |
| Average maintenance | 80% after 6000 h |
| Electrode spacing/mm | 27.5 |
| Bulb volume/ml | 8 |
| Discharge vessel fill gas | 100 h Pa Ar |
| Outer bulb fill gas | Vacuum |
| Fill in mg | 16 mg of Hg, 3.32 mg of $DyI_3$, 0.3 mg of $GdI_3$, 1.75 mg of CsI, 0.08 mg of TlI |
| Color rendering index Ra | 90 |
| Wall loading W/cm$^2$ | 18 |

Figure 4:
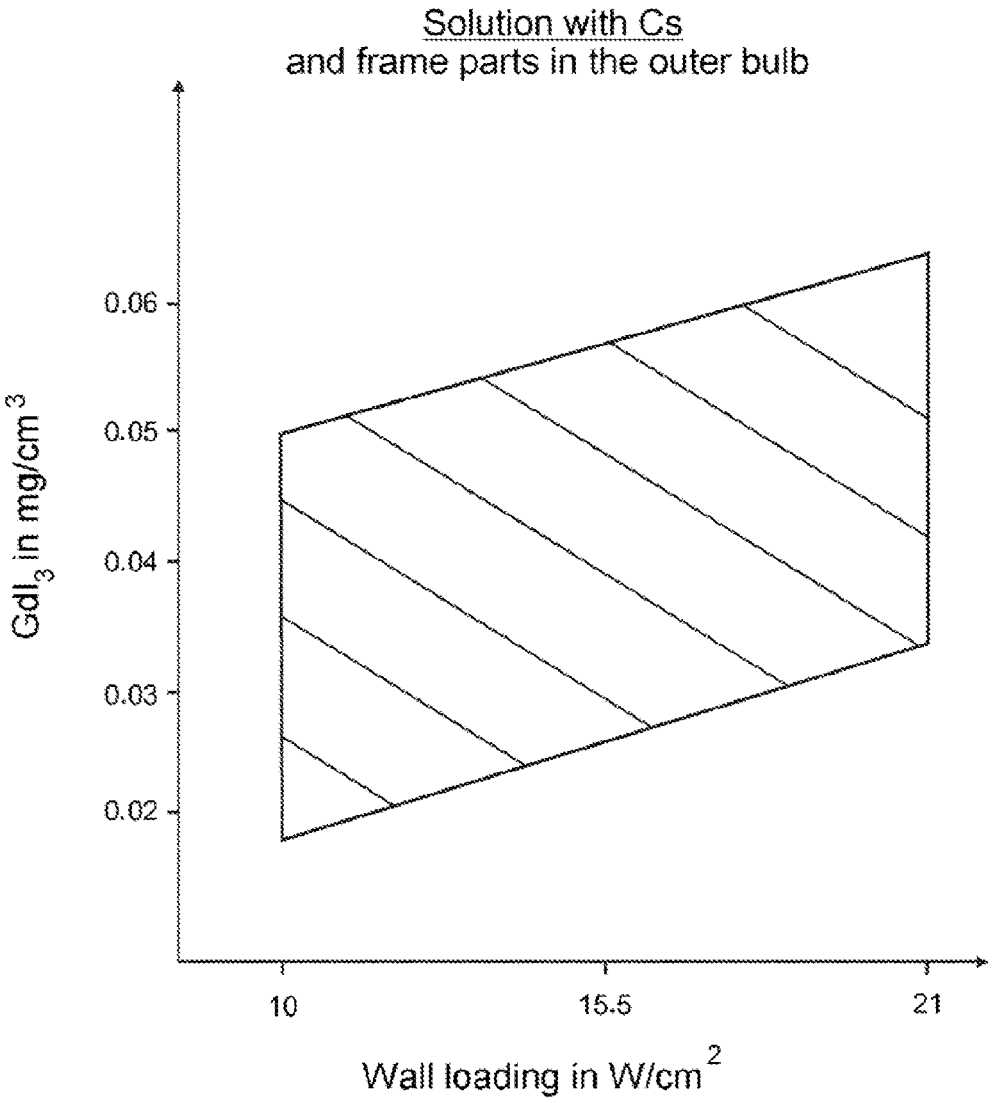
FIG. 4 shows an illustration of a favorable range for $GdI_3$ depending on the wall loading for a fill with Cs.

FIG. 4 shows, similarly, an advantageous range for $GdI_3$ as fill in interaction with CsI in relation to the wall loading. At a low wall loading of 10 W/cm$^2$, metering of 0.02 to 0.05 mg/cm$^3$ is advantageous. As the wall loading increases, the metering also increases up to a value of 0.035 to 0.065 mg/cm$^3$ at 21 W/cm$^2$. The discharge vessel is in this case held in the outer bulb by means of a frame (see FIG. 1).

TABLE 2

| | |
|---|---|
| Power/W | 400 |
| Luminous flux/lm | 28 000 |
| Color temperature/K | 8000 |
| Average life/h | 12 000 |
| Average maintenance | 80% after 6000 h |
| Electrode spacing/mm | 30 |
| Bulb volume/ml | 14 |
| Burner fill gas | 100 h Pa Ar |
| Outer bulb fill gas | Vacuum |
| Fill in mg | 60 mg of Hg, 4.8 mg of $DyI_3$, 0.52 mg of $GdI_3$, 2.56 mg of CsI, 0.12 mg of TlI |
| Color rendering index Ra | 92 |
| Wall loading W/cm$^2$ | 12 |

TABLE 3

| | |
|---|---|
| Power/W | 75 |
| Luminous flux/lm | 5200 |
| Color temperature/K | 8000 |
| Average life/h | 12 000 |
| Average maintenance | 80% after 6000 h |
| Electrode spacing/mm | 8 |
| Bulb volume/ml | 0.7 |
| Burner fill gas | 100 h Pa Ar |
| Outer bulb fill gas | 180 h Pa Ar |
| Fill in mg | 8.2 mg of Hg, 0.34 mg of $TmI_3$, 0.44 mg of $GdI_3$, 0.21 mg of NaI, 0.05 mg of TlI, 0.05 mg of InI |
| Color rendering index Ra | 80 |
| Wall loading W/cm$^2$ | 20 |

TABLE 4

| | |
|---|---|
| Power/W | 150 |
| Luminous flux/lm | 12 000 |
| Color temperature/K | 8000 |
| Average life/h | 12 000 |
| Average maintenance | 80% after 6000 h |
| Electrode spacing/mm | 15 |
| Bulb volume/ml | 1.7 |

TABLE 4-continued

| | |
|---|---|
| Burner fill gas | 100 h Pa Ar |
| Outer bulb fill gas | 180 h Pa Ar |
| Fill in mg | 12.1 mg of Hg, 0.58 mg of $TmI_3$, 0.44 mg of $GdI_3$, 0.93 mg of NaI, 0.11 mg of TlI, 0.15 mg of InI |
| Color rendering index Ra | 80 |
| Wall loading $W/cm^2$ | 20 |

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A high-pressure discharge lamp comprising:

an outer bulb, which surrounds a discharge vessel, wherein a fill which contains mercury and a noble gas from the group consisting of neon, argon, krypton, xenon on its own or in a mixture is accommodated in the discharge vessel, wherein the fill contains Gd in halide form in order to produce a color temperature of at least 7500 K, wherein the coldfilling pressure of the noble gas is selected in the range from 30 to 300 hPa; and wherein the high-pressure discharge lamp further comprises a total wall loading ranging from 10 to 21 $W/cm^2$.

2. The high-pressure discharge lamp as claimed in claim 1, wherein Gd is introduced in the form of $GdI_3$ and/or $GdBr_3$.

3. The high-pressure discharge lamp as claimed in claim 1, wherein the fill contains, as further metal halides, rare-earth halides.

4. The high-pressure discharge lamp as claimed in claim 1, wherein the total metal halide fill quantity is at most 2 $mg/cm^3$, based on the volume of the discharge vessel of the high-pressure discharge lamp.

5. The high-pressure discharge lamp as claimed in claim 1, wherein the content of Hg is selected in the range from 3 to 30 $mg/cm^3$.

6. The high-pressure discharge lamp as claimed in claim 1, wherein the fill contains NaI and GdI3, wherein the proportion of GdI3 is greater than 15% by weight, wherein the discharge vessel of the high-pressure discharge lamp is surrounded by the outer bulb without a frame.

7. The high-pressure discharge lamp as claimed in claim 1, wherein the fill contains GdI3 and Cs halide, wherein the proportion of GdI3 is at most 15% by weight, wherein the discharge vessel of the high-pressure discharge lamp is held in the outer bulb by means of a frame.

8. The high-pressure discharge lamp as claimed in claim 1, wherein the metering of Gd halide lies in a region which is covered by a quadrilateral with the corner points 0.1 $mg/cm^3$ to 0.6 $mg/cm^3$ at 10 $W/cm^2$ and 0.25 $mg/cm^3$ to 0.75 $mg/cm^3$ at 21 $W/cm^2$, wherein a further fill constituent is Na halide.

9. The high-pressure discharge lamp as claimed in claim 1, wherein the metering of Gd halide lies in a region which is covered by a quadrilateral with the corner points 0.018 $mg/cm^3$ to 0.05 $mg/cm^3$ at 10 $W/cm^2$ and 0.035 $mg/cm^3$ to 0.063 $mg/cm^3$ at 21 $W/cm^2$, wherein a further fill constituent is Cs halide.

* * * * *